US008133021B2

(12) United States Patent
Fingerhut et al.

(10) Patent No.: US 8,133,021 B2
(45) Date of Patent: Mar. 13, 2012

(54) MULTISTAGE TURBOCOMPRESSOR

(75) Inventors: Udo Fingerhut, Lünen (DE); Wolfgang Zacharias, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 655 days.

(21) Appl. No.: 12/227,722

(22) PCT Filed: May 21, 2007

(86) PCT No.: PCT/EP2007/054888

§ 371 (c)(1),
(2), (4) Date: Nov. 25, 2008

(87) PCT Pub. No.: WO2007/137959

PCT Pub. Date: Dec. 6, 2007

(65) Prior Publication Data

US 2009/0175717 A1 Jul. 9, 2009

(30) Foreign Application Priority Data

May 26, 2006 (EP) ..... 06010926

(51) Int. Cl.
*F01D 25/26* (2006.01)
*F01D 25/28* (2006.01)

(52) U.S. Cl. ..... 415/213.1; 415/214.1

(58) Field of Classification Search ..... 415/170.1, 415/175, 213.1, 214.1
See application file for complete search history.

(56) References Cited

U.S. PATENT DOCUMENTS

| | | | | |
|---|---|---|---|---|
| 3,802,795 | A * | 4/1974 | Nyeste et al. | 415/122.1 |
| 3,874,814 | A | 4/1975 | Carroll | |
| 3,976,395 | A * | 8/1976 | Kalnin et al. | 415/199.2 |
| 6,398,484 | B1 * | 6/2002 | Orikasa et al. | 415/112 |
| 2007/0274822 | A1 * | 11/2007 | Liu et al. | 415/90 |

FOREIGN PATENT DOCUMENTS

| | | | |
|---|---|---|---|
| FR | 2324909 | A1 | 4/1977 |
| WO | WO 9213196 | A1 | 8/1992 |
| WO | WO 2005061896 | A2 | 7/2005 |

* cited by examiner

*Primary Examiner* — Caridad Everhart

(57) ABSTRACT

A dynamic compressor, in particular a turbo compressor, having an exterior housing, a compressor unit featuring a tubular housing with an outer wall and a circular cross section, wherein the compressor unit is received by a circular opening which is located in the exterior housing and has an inner wall. Two compressor elements, which are at a distance from each other, are provided between the outer wall of the tubular housing and the inner wall of the opening in which the compressor unit is received, and wherein, furthermore, a fluid supply line is provided which penetrates the exterior housing and extends between the compressor elements which are at a distance from each other.

13 Claims, 2 Drawing Sheets

MULTISTAGE TURBOCOMPRESSOR

CROSS REFERENCE TO RELATED APPLICATIONS

This application is the US National Stage of International Application No. PCT/EP2007/054888 filed May 21, 2007 and claims the benefit thereof. The International Application claims the benefit of European application No. 06010926.1 EP filed May 26, 2006. Both of the applications are incorporated by reference herein in their entirety.

FIELD OF INVENTION

The invention relates to a dynamic compressor, especially a turbocompressor, with an outer casing and a compressor unit which has a tubular housing with an outer wall and a preferably circular cross section, wherein the compressor unit is accommodated in at least one preferably circular opening which is formed in the outer casing and has an inner wall.

BACKGROUND OF INVENTION

Compressor units in dynamic compressors, especially in turbocompressors, have to be centered in close fits. A fit which is formed insufficiently close results in the clearances which are required between rotating components, such as the rotor in particular, and fixed components, such as the housing of the compressor unit, not being able to be formed as sufficiently close as is required for a sufficiently high efficiency.

SUMMARY OF INVENTION

A centering which is carried out in sufficiently close fits, however, results in the fitting points "gumming-up" when compressing contaminated or corrosive gases. This "gumming-up" of the fitting points results in a disassembly of the turbocompressor being possible only with great difficulty and perhaps no longer possible at all.

An object of the invention is to create a dynamic compressor, especially a turbocompressor, which can be disassembled without many difficulties even after compression of contaminated or corrosive gases.

This object is achieved with the dynamic compressor which is mentioned in the introduction, especially a turbocompressor, in which two sealing elements, which are spaced apart from each other, are provided between the outer wall of the tubular housing and the inner wall of the opening in which the compressor unit is accommodated, and wherein a fluid feed line is additionally provided, which penetrates the outer casing and extends to between the sealing elements which are spaced apart from each other.

The compressor unit, in the tubular housing of which the stator elements together with the rotating wheels, which are attached on a shaft, are arranged, is accommodated in a preferably circular opening of the outer casing, in fact with a close fit in order to ensure sufficiently small clearances between the rotating wheels, which rotate with the shaft, and the inner wall of the tubular housing, which clearances are absolutely necessary for a sufficiently high efficiency of the dynamic compressor, especially of a turbocompressor.

Two sealing elements, which are spaced apart from each other, are provided between the outer wall of the tubular housing and the inner wall of the opening in which the compressor unit is accommodated. These sealing elements, which are spaced apart from each other, together with the outer wall of the tubular housing and the inner wall of the opening in which the compressor unit is accommodated, form an annular space. A fluid feed line, to which fluid, especially oil, can be fed from outside, extends into the space which is thus formed in order to fill the annular space with oil and especially to pressurize the space with high oil pressure. As a result of the high oil pressure which can be thus established in the annular space, gums which are formed as result of compression of contaminated or corrosive gases and which are found between the housing outer wall of the compressor unit and the inner wall of the opening, can be removed by lubricating and expanding, wherein the gums otherwise seriously hamper a withdrawal or forcing out of the compressor unit from the opening which is formed in the form of a close fit, or perhaps make it impossible.

From an overall viewpoint, radial and/or axial forces can be created by means of the space which is thus formed and which can be pressurized with oil pressure. Gumming-up of the compressor unit in the opening of the compressor unit, which is a result of the compression of contaminated or corrosive gases, can be removed without any problem by means of these forces. A disassembly of the compressor, which for example is to be undertaken for maintenance operations and during which the compressor unit is especially to be released from its opening, can then be undertaken without any problem after loosening of the gum.

In an advantageous development of the invention, the fluid feed line is formed by one or more bores which extend through the outer casing to between the sealing elements, which are spaced apart from each other, as result of which a fluid distribution, especially an oil distribution, can be realized in a practical manner, that is to say especially without providing additional pressurized pipe lines, for example.

In a practical development of the invention, the sealing elements are arranged in each case in a groove which is formed in the outer wall of the tubular housing. Alternatively, the sealing elements can also be arranged in each case in a groove which is formed in the inner wall of the opening of the outer casing.

In an especially practical development of the invention, the tubular housing has a step-shaped section which comprises a first part with a first outer wall section, and a second part with a second outer wall section, wherein the first part is offset in relation to the second part, and wherein the at least one opening which is formed in the outer casing is adapted to the shape of the step, and has a first inner wall section, which lies opposite the first outer wall section, and a second inner wall section, which lies opposite the second outer wall section, and wherein in addition one of the two sealing elements is provided between the first outer wall section and the first inner wall section, and the other sealing element is provided between the second outer wall section and the second inner wall section.

The step which is thus formed acts like a piston which can be exposed to application of oil pressure via the fluid feed line which is provided in order to force the compressor unit from its opening, as result of which additional advantageous means are ultimately made available for the disassembly of the dynamic compressor. By means of the sealing elements it is ensured in this case that a sufficiently high oil pressure can be built up. The step-shaped section can also be formed in two pieces in such a way that the first part is detachably connected to the second part. Furthermore, the piston which is formed can be used for radially and/or axially separating parts from each other, which are perhaps stuck to each other, for disassembly purposes by applying oil pressure to the piston.

BRIEF DESCRIPTION OF THE DRAWINGS

An exemplary embodiment of a turbocompressor subsequently explained in more detail with reference to the attached drawings. In the drawing.

DETAILED DESCRIPTION OF INVENTION

Figure 1:
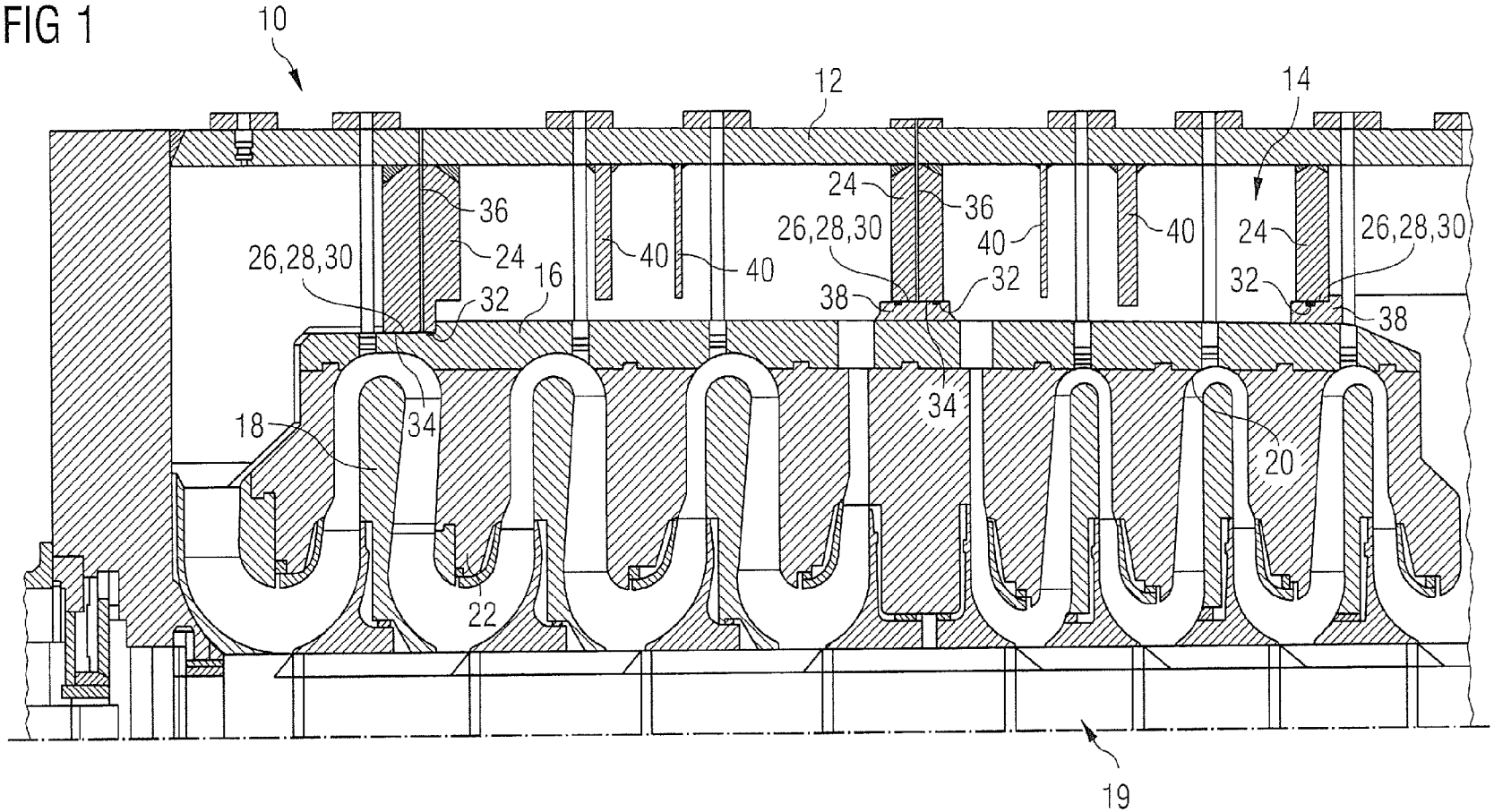
FIG. 1 shows a half-sectional view of a turbocompressor.

In FIG. 1, a turbocompressor 10 is shown in a half-sectional view. The turbocompressor 10 comprises an outer casing 12 in which a compressor unit 14 in the form of a bundle is arranged. The compressor unit 14 comprises an inner casing in the form of a tubular housing 16 in which a rotating wheel 18 is attached on a shaft 19. A stator element 22 is attached on the inner wall 20 of the tubular housing.

Three casing elements in the form of support walls 24 extend radially from the outer casing 12 and in the present case are also provided as partitions for different process stages. The compressor unit 14 is accommodated in a close fit in each case in three circular openings 26 which are formed in the support walls 24 and are axially oriented.

Between the inner wall 28 of the opening 26 which is formed in the support wall 24 which in FIG. 1 is arranged on the left, which inner wall is provided as a seat for the compressor unit 14, and the outer wall 30 of the tubular housing 16, two sealing elements 32 are arranged spaced-apart from each other in sealing element grooves which are formed in the tubular housing 16. Alternatively, the sealing element grooves can also be formed in the inner wall 28 of the opening 26. In the present case, the two sealing elements 32, which are spaced apart from each other, extend around the tubular housing 16 and together with the outer wall 30 of the tubular housing 16 and the inner wall 28 of the opening 26 in which the compressor unit 14 is accommodated, form an annular space 34. From this space 34, a bore 36 extends outwards through the support wall 24 and the outer casing 12.

Oil can be fed from outside via a hydraulic connection (not shown) to the bore 36 in order to fill the annular space 34 with oil and especially to put it under high oil pressure. As a result of the high oil pressure which can be thus established in the annular space 34, gums which are formed as a result of compression of contaminated or corrosive gases and are to be found between the outer wall 30 of the tubular housing 16 and the inner wall 28 of the accommodating opening 26 can be removed by lubricating and expanding, which gums would otherwise seriously hamper a pulling out or forcing out of the compressor unit 14 from the opening which is formed in the form of a close fit, or perhaps would make this impossible. At the same time, an axial force is created, which assists a forcing out of the compressor unit 14 from the fit, especially for disassembly purposes.

The support wall 24, which is arranged in the center in FIG. 1, is also sealed in relation to a collar 38 by means of two sealing elements 32 which are spaced apart from each other, wherein the sealing elements 32 are accommodated in grooves which are formed in the collar 38. Alternatively, the grooves can also be formed in the inner wall 28 of the centrally arranged support wall 24. Also, these two sealing elements 32, in conjunction with the end face of the collar 38 which encompasses the compressor unit 14, and in conjunction with the inner wall 28 of the opening 26 which is formed in the support wall 24, form an annular space 34 which by applying oil pressure in the bore 36 can be radially widened. Also in this case, the compressor unit 14 together with the collar 38 is accommodated in a close fit in the opening 26 which is formed in the support wall 24.

In the support wall 24 which is shown on the right in FIG. 1, the opening 26 serves for accommodating the compressor unit 14 together with a collar 38 which encompasses the housing 16 of the compressor unit 14, wherein only one sealing element 32 is provided in this case so that forming of an annular space is not provided with regard to this support wall 24, and consequently no floating bearing of the compressor unit 14 by means of oil pressure is provided either. In addition, more radial walls 40, which in the present case are formed in the form of baffle plates, extend from the outer casing 12.

Alternatively, the support walls 24 can also extend from the housing 16 of the compressor unit 14, wherein in this case the sealing elements 32 are arranged between the inner wall of the outer casing 12 and the free end faces of the support walls 24.

The support walls 24 can be welded onto the housing 16 of the compressor unit 14 or on the outer casing 12. Furthermore, the support walls can also be in one piece with the outer casing 12 or with the housing 16 of the compressor unit 14 in such a way that for example they are already milled from the "solid" during the manufacture of the housing 16 or of the outer casing 12. The support walls 24 which are provided enable an effective support between outer casing 12 and compressor unit 16.

Figure 2:
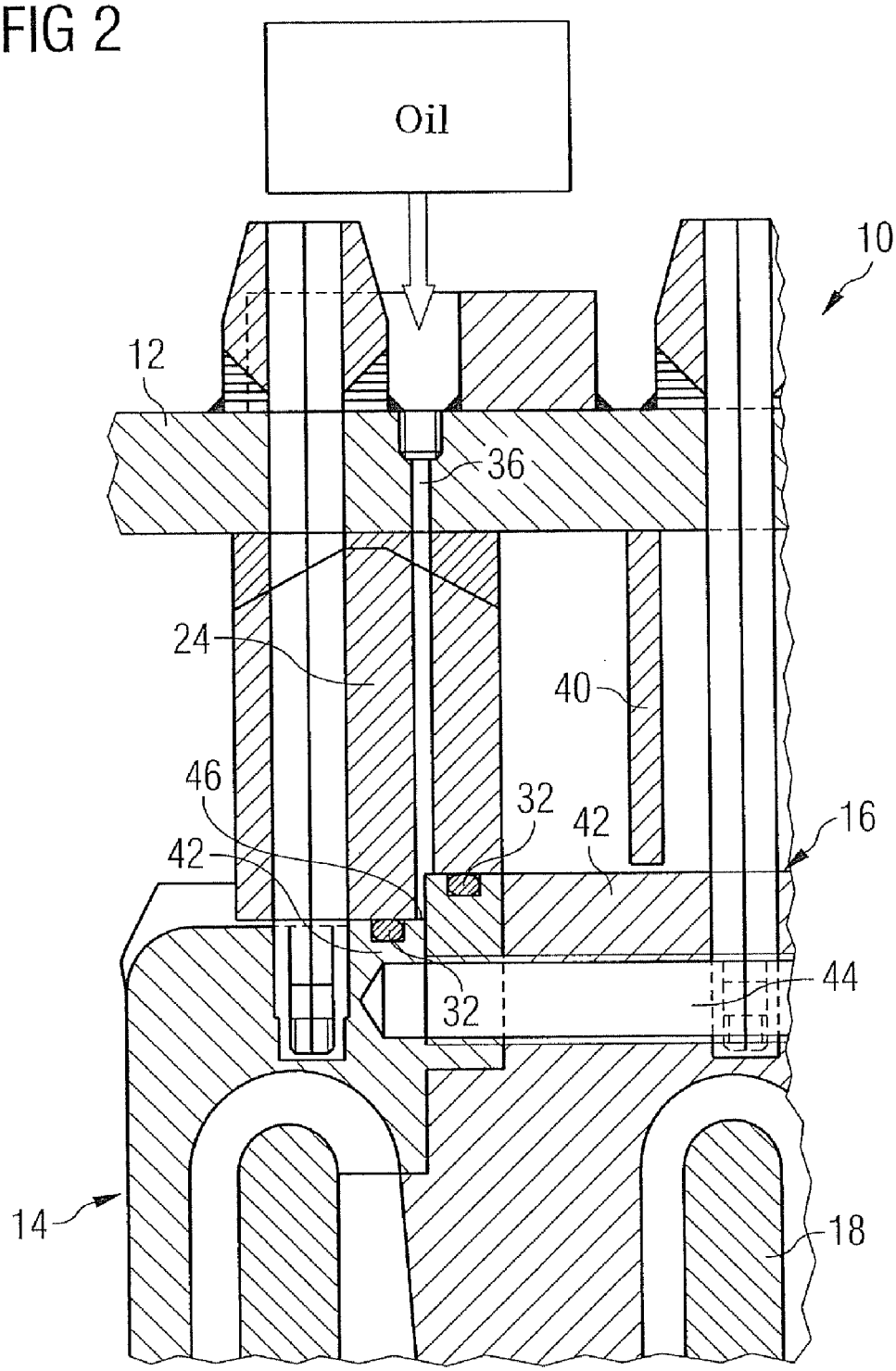
FIG. 2 shows a sectional view of a detail of a further turbocompressor.

FIG. 2 shows a sectional view of a detail of a further turbocompressor 10 wherein the housing 16 of the compressor unit 14 has a step-shaped section which comprises two parts 42 which are radially offset to each other. The two parts 42 are interconnected via a threaded connection 44. As a result of the offset of the two parts 42, a step-shaped transition point is formed, wherein the compressor unit 14 bears axially upon this transition point. Also in this case, two sealing elements 32 are provided in case for sealing, wherein a bore 36 extends from outside through the outer casing 12 and extends further through the support wall 24 as far as the step-shaped transition point. If the step-shaped transition point, which acts like a piston, is exposed to application of oil pressure, a force which is directed axially to the right acts upon the right-hand housing section 42. By means of a suitably high oil pressure, therefore, the housing 16 can be forced from its opening which is formed in the support wall 24. In this way, the disassembly of the turbocompressor 10 can be significantly simplified.

The invention claimed is:

1. A dynamic compressor, comprising:

an outer casing;

a compressor unit, which has a tubular housing with an outer wall, wherein the compressor unit is accommodated in an opening which is formed in the outer casing and has an inner wall;

two sealing elements between the outer wall of the tubular housing and the inner wall of the opening in which the compressor unit is accommodated, the two sealing elements spaced apart from each other; and a fluid feed line, which penetrates the outer casing and extends to between the sealing elements.

2. The dynamic compressor as claimed in claim 1, wherein the tubular housing has a circular cross section.

3. The dynamic compressor as claimed in claim 1, wherein the opening of the outer casing is a circular opening.

4. The dynamic compressor as claimed in claim 1, wherein the compressor is a turbocompressor.

5. The dynamic compressor as claimed in claim 1, wherein the tubular housing has a step-shaped section with a first part having a first outer wall section and a second part having a second outer wall section, and the first part is offset in relation to the second part, the opening which is formed in the outer casing is adapted to the shape of the step, and has a first inner wall section, which lies opposite the first outer wall section, and a second inner-wall section, which lies opposite the second outer wall section, and one of the two sealing elements is provided between the first outer wall section and the first inner wall section, and the other sealing element is provided between the second outer wall section and the second inner wall section.

6. The dynamic compressor as claimed in claim 1, wherein the fluid feed line is formed by one or more bores which extend through the outer casing to between the sealing elements which are spaced apart from each other.

7. The dynamic compressor as claimed in claim 6, wherein the sealing elements are arranged in each case in a groove which is formed in the outer wall of the tubular housing.

8. The dynamic compressor as claimed in claim 6, wherein the sealing elements are arranged in each case in a groove which is formed in the inner wall of the opening of the outer casing.

9. The dynamic compressor as claimed in claim 6, wherein the tubular housing has a step-shaped section with a first part having a first outer wall section and a second part having a second outer wall section, and the first part is offset in relation to the second part, the opening which is formed in the outer casing is adapted to the shape of the step, and has a first inner wall section, which lies opposite the first outer wall section, and a second inner-wall section, which lies opposite the second outer wall section, and one of the two sealing elements is provided between the first outer wall section and the first inner wall section, and the other sealing element is provided between the second outer wall section and the second inner wall section.

10. The dynamic compressor as claimed in claim 1, wherein the sealing elements are arranged in each case in a groove which is formed in the outer wall of the tubular housing.

11. The dynamic compressor as claimed in claim 10, wherein the tubular housing has a step-shaped section with a first part having a first outer wall section and a second part having a second outer wall section, and the first part is offset in relation to the second part, the opening which is formed in the outer casing is adapted to the shape of the step, and has a first inner wall section, which lies opposite the first outer wall section, and a second inner-wall section, which lies opposite the second outer wall section, and one of the two sealing elements is provided between the first outer wall section and the first inner wall section, and the other sealing element is provided between the second outer wall section and the second inner wall section.

12. The dynamic compressor as claimed in claim 1, wherein the sealing elements are arranged in each case in a groove which is formed in the inner wall of the opening of the outer casing.

13. The dynamic compressor as claimed in claim 12, wherein the tubular housing has a step-shaped section with a first part having a first outer wall section and a second part having a second outer wall section, and the first part is offset in relation to the second part, the opening which is formed in the outer casing is adapted to the shape of the step, and has a first inner wall section, which lies opposite the first outer wall section, and a second inner-wall section, which lies opposite the second outer wall section, and one of the two sealing elements is provided between the first outer wall section and the first inner wall section, and the other sealing element is provided between the second outer wall section and the second inner wall section.

* * * * *